United States Patent [19]

Nelson et al.

[11] Patent Number: 4,720,071

[45] Date of Patent: Jan. 19, 1988

[54] SPLIT NUT MECHANICAL HEIGHT ADJUSTING MECHANISM FOR CHAIR

[75] Inventors: Patrick C. Nelson; Donald L. Cool, both of Holland, Mich.

[73] Assignee: Haworth, Inc., Holland, Mich.

[21] Appl. No.: 943,969

[22] Filed: Dec. 19, 1986

[51] Int. Cl.[4] ..... F16M 11/24

[52] U.S. Cl. ..... 248/406.2; 297/345

[58] Field of Search ..... 248/406.2, 406.1, 188.4, 248/405, 406, 157; 297/347, 348, 345, 346; 411/271, 265

[56] References Cited

U.S. PATENT DOCUMENTS

| | | | |
|---|---|---|---|
| 2,702,075 | 2/1955 | Richards . | |
| 3,164,357 | 1/1965 | Hage et al. | 248/406.2 |
| 3,599,924 | 8/1971 | Schmidgall | 248/403 |
| 3,727,871 | 4/1973 | Harper | 248/406.2 |
| 3,799,485 | 4/1973 | Wolters | 248/406.2 |
| 3,799,486 | 3/1974 | Mohr et al. | 248/406.2 |
| 3,870,270 | 3/1975 | Holtz | 248/406.2 |
| 3,870,271 | 3/1975 | Bowman | 248/406.2 |
| 3,991,965 | 11/1976 | Westover et al. | 248/406.2 |
| 4,026,509 | 0/1977 | Wolters | 248/406.2 |
| 4,261,540 | 4/1981 | Baker et al. | 248/406.2 |
| 4,324,382 | 4/1982 | Beukema | 248/406.2 |
| 4,379,540 | 4/1983 | French | 248/406.2 |
| 4,394,001 | 7/1983 | Wisniewski | 248/406.2 X |
| 4,494,721 | 1/1985 | Trinkel | 248/406.2 |
| 4,540,148 | 9/1985 | Mann | 248/406.2 |
| 4,598,892 | 7/1986 | Franckowiak et al. | 248/406.2 |

FOREIGN PATENT DOCUMENTS

| | | |
|---|---|---|
| 687506 | 1/1940 | Fed. Rep. of Germany . |
| 647183 | 12/1950 | United Kingdom . |
| 1029020 | 5/1966 | United Kingdom . |

*Primary Examiner*—J. Franklin Foss
*Assistant Examiner*—David L. Talbott
*Attorney, Agent, or Firm*—Flynn, Thiel, Boutell & Tanis

[57] ABSTRACT

A load-released height-adjusting mechanism coacting between the relatively rotatable spindle and pedestal of a chair. The mechanism employs a split nut threadably engaged with the pedestal. A wedge is continuously spring-urged into engagement with the nut for urging the sectors thereof radially for engagement with the threaded pedestal. The wedge is loaded downwardly by the spindle when the chair seat is occupied to cause the nut sectors to lockingly and nonrotatably engage the pedestal to permit free rotation of the spindle without effecting height adjustment. The wedge is not acted on by the spindle when the latter is in a raised position due to the chair seat being unoccupied, but the frictional treaded engagement between the pedestal and nut prevents free-wheeling of the chair while permitting manual rotation of the chair seat and nut to effect height adjustment.

10 Claims, 5 Drawing Figures

SPLIT NUT MECHANICAL HEIGHT ADJUSTING MECHANISM FOR CHAIR

FIELD OF THE INVENTION

This invention relates to a load-released height-adjusting mechanism associated with the support spindle of a swivel chair and, in particular, to an improved mechanism having means associated therewith for preventing accidental height loss.

BACKGROUND OF THE INVENTION

Height-adjusting mechanisms of the aforesaid type, wherein the height of the chair seat is adjusted by rotation of the chair seat when unoccupied, with the adjusting mechanism being disengaged when the chair seat is occupied, are well known and such mechanisms are widely used on spindle-type office chairs. Examples of known height-adjusting mechanisms for chairs are disclosed in U.S. Pat. Nos. 4,324,382, 4,394,001, 4,026,509, 3,799,485, 3,164,357, 3,599,924, 3,727,871, 3,870,271, 3,991,965, 4,540,148, 4,494,721, 3,870,270, 4,379,540 and 2,702,075.

In a typical height-adjusting mechanism, such as illustrated in many of the above-identified patents, a spindle is threadably engaged with a nut which can be suitably held in nonrotatable relationship relative to either the base or the chair seat so as to define adjusting and nonadjusting positions. A spring normally urges the chair seat slightly upwardly when it is unoccupied so that the nut is clutchably connected to the base, whereby rotation of the seat causes the spindle to threadably move through the nut and hence cause a height adjustment of the seat. Conversely, when the chair seat is occupied, the external load imposed on the chair seat overcomes the spring and moves the chair seat and spindle downwardly a limited amount so that the nut is nonrotatably engaged with the spindle, whereby swiveling or rotating the occupied chair seat does not change its height.

While height-adjusting mechanisms of the aforementioned and similar types have performed in a generally satisfactory manner relative to their capability to permit deliberate adjustments in height, nevertheless it has been observed that many of these mechanisms permit undesirable height loss. More specifically, in many of the mechanisms it has been observed that when an occupant exits a chair, the chair is forcibly rotated through a part of a revolution due to the occupant rising and then walking away from the chair, during which movement the occupant effects a limited swiveling of the chair. In many of the known height-adjusting mechanisms, this limited swiveling is assisted in part by the weight of the chair and is sufficient to effectively cause an undesired amount of free-wheeling rotation of the chair seat so that the chair tends to unwind downwardly along the nut. Hence, each time the occupant departs the chair, a small height loss may occur and, while each height loss itself may be a very small vertical increment, nevertheless these increments gradually accumulate to a sufficient magnitude as to require the occupant to readjust the chair height.

In an attempt to overcome this problem, some height-adjusting mechanisms have attempted to incorporate an additional braking feature so as to prevent free-wheeling of the chair when the occupant leaves the chair.

For example, U.S. Pat. No. 4,379,540 discloses a screw-nut height-adjusting mechanism which additionally employs a split friction sleeve which coacts between the relatively rotatable spindle and screw for exerting a continuous frictional drag therebetween so as to prevent undesired relative rotation therebetween and hence undesired loss of height. The overall mechanism of this patent, however, possesses structural and functional relationships which are considered inadequate in order to provide a chair having desired load-carrying and reliability characteristics. This mechanism is further complicated by requiring a threaded adjustment shaft separate from the support spindle, and wear of the friction sleeve will probably be excessive so as to hence prevent the mechanism from providing satisfactory long-term operation.

British Patent Specification No. 647 183 and German Patentschrift No. 687 506 both disclose a nut threaded to a spindle and spring-urged axially to frictionally engage a support pedestal when the seat is unoccupied to permit height adjustment. The nut has or cooperates with a wedge-shaped split sleeve which is urged into frictional engagement with the threaded spindle when the seat is occupied. This latter relation creates an undesirable friction brake. Also, with the nut surrounding and threadably engaging the spindle, assembly and/or disassembly, particularly from the bottom of the pedestal, is difficult or impossible due to the spring loading so that disassembly from the top of the pedestal is normally required. This unduely complicates the pedestal structure, including the overall exterior appearance of the pedestal, and makes assembly and disassembly a complex and time consuming operation.

In addition, in the arrangement of the aforementioned British patent, the thread goes through the bearing housing and acts as an interrupted bearing surface for the spindle. This provides a wholly undesirable bearing arrangement, particularly during swiveling of the chair seat.

Another and very significant disadvantage of the known mechanisms, such as those identified above, is the relationship between the maximum height adjustment range versus the overall height of the mechanism. The known mechanisms have typically required a significantly large mechanism height, such as to provide the necessary spring size and deflection, in order to result in the mechanism having the desired range of height adjustment. Such mechanisms typically cannot be used in conjunction with a knee-type tilt control since such control itself typically occupies a significant vertical space beneath the chair seat and hence significantly reduces the vertical space available for the height-adjusting mechanism.

Accordingly, this invention relates to an improved height-adjusting mechanism for a spindle or pedestal-type chair, which mechanism is capable of providing a desirable height-adjusting function when the chair seat is unoccupied, which provides a maximum height adjusting range while minimizing the overall height of the mechanism, which creates a sufficient frictional engagement between the support tube and the chair spindle even when the chair seat is unoccupied as to prevent undesired height loss, which is readily and efficiently adjustable when desired, which is reasonably economical to manufacture, which can be readily disassembled and/or assembled from the lower end of the pedestal to simplify maintenance requirements, and which is believed to possess a high degree of reliability and durability.

In the improved height-adjusting mechanism of this invention, a non-threaded spindle as nonrotatably secured to the chair seat is rotatably telescopically supported within a support tube secured to the base. The spindle is urged upwardly (when the chair seat is unoccupied) by a spring which is confined between the spindle and a conical wedge disposed directly thereunder. The wedge is disposed for wedging engagement within a conical recess formed in a split nut, the latter being disposed in continuous externally threaded engagement with an internal thread formed on the support tube. A clutch member is secured to the spindle and clutchingly cooperates with the split nut. When the chair seat is occupied, the occupant weight acts through the spindle onto the wedge, whereby the nut is wedged radially outwardly into tight wedging engagement with the internal threads on the support tube so as to lock up the nut and prevent rotation thereof. The spindle can thus rotate about its vertical swivel axis so as to accommodate the desired swiveling by the chair occupant. In this occupied position, the clutch member is disengaged from the nut. When the chair is unoccupied, the spring urges the spindle upwardly and causes the clutch member to clutchingly engage the nut. This also relieves the occupant weight from the wedge so that the wedge is urged into engagement with the split nut solely by the spring. The split nut hence remains threadably engaged with the internally threaded support tube, which engagement is of significantly lesser magnitude since it is created solely by the spring force imposed on the wedge, whereby the nut can freely rotate within the support tube and will so rotate so as to cause height adjustment when the chair is manually rotated while unoccupied. However, due to the frictional engagement created between the nut and the internally threaded support tube, and the fact that the nut is nonrotatably coupled to the spindle, the chair seat will not freewheel, but rather will be rotatable for height adjustment only when a deliberate rotating force is manually applied to the chair seat.

Other objects and purposes of the invention will be apparent to persons familiar with mechanisms of this general type upon reading the following specification and inspecting the accompanying drawings.

Figure 1:
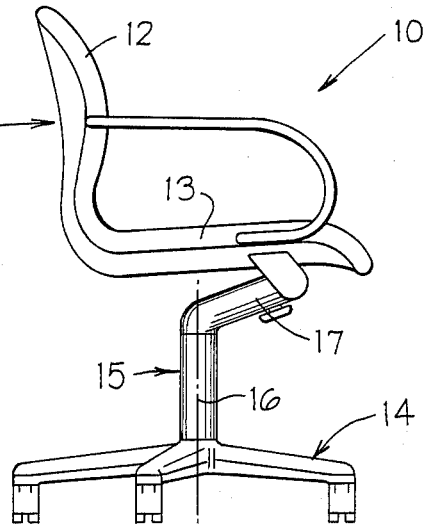
FIG. 1 is a diagrammatic elevational view of a swivel or pedestal chair employing the improved height-adjusting mechanism of this invention therein.

Certain terminology will be used in the following description for convenience in reference only, and will not be limiting. For example, the words "upwardly", "downwardly", "rightwardly" and "leftwardly" will refer to directions in the drawings to which reference is made. The words "upwardly" and "downwardly" will also refer to the direction of movement of the chair seat responsive to the height adjustment thereof. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

Figure 2:
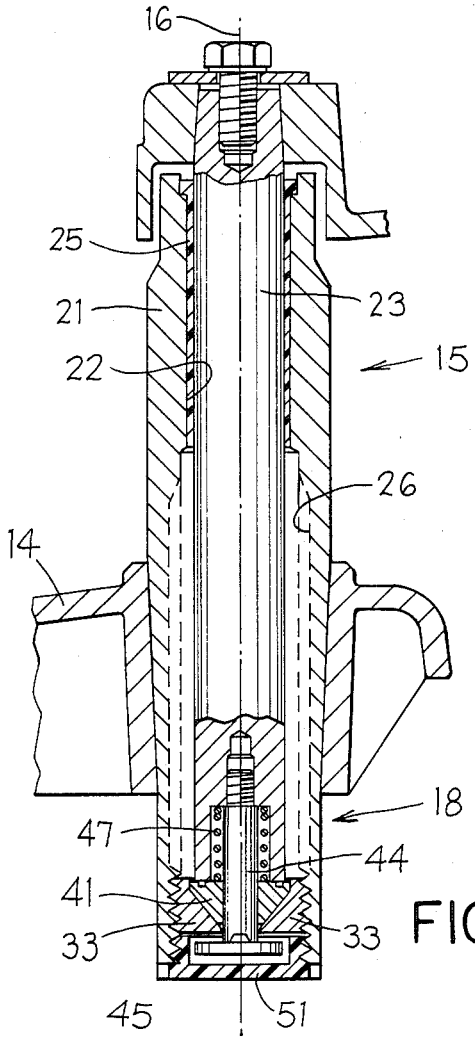
FIG. 2 is a fragmentary elevational view, partially in cross section, illustrating the spindle assembly, including the height-adjusting mechanism, used for joining the seat assembly and base.

Referring to FIGS. 1 and 2, there is illustrated an office-type chair 10 having a seat assembly 11 which, in the illustrated embodiment, comprises a back 12 and seat 13 which are integrally joined, although they could obviously be separate as is well known. The seat 13 is supported on a base 14 which, as is conventional, preferably employs a plurality, here five, of radially projecting legs each typically having a roller or caster adjacent the outer end thereof. A swivel-type pedestal assembly 15 joins the base 14 and seat 13 and defines a vertical swivel axis 16 about which the seat can rotate relative to the base. A knee-type tilt control mechanism 17 is connected between the upper end of the pedestal assembly 15 and the seat 13 to permit tilting of the latter about a horizontal tilt axis located adjacent the front edge of the chair seat, which tilt mechanism may be of any conventional configuration. The pedestal assembly 15 also has a height-adjusting mechanism 18 associated therewith, which mechanism permits height adjustment to occur when the chair seat is unoccupied and permits free swiveling of the chair seat when it is occupied. The structure and operation of the height-adjusting mechanism 18 will be described below.

Figure 3:
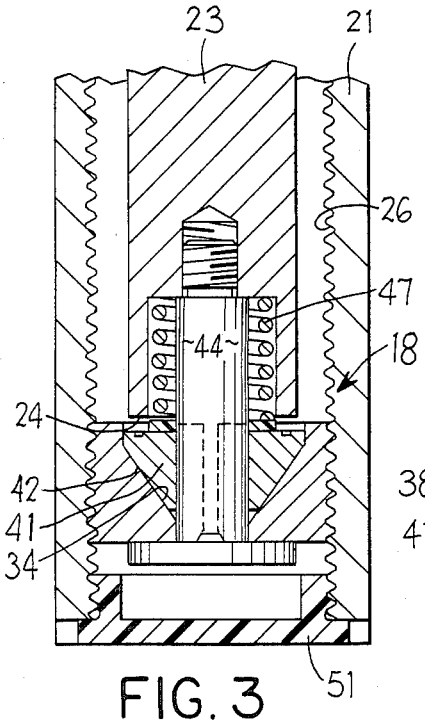
FIG. 3 is an enlarged, fragmentary, cross-sectional view of the height-adjusting mechanism in the adjusting position wherein the chair seat is unoccupied.
Figure 4:
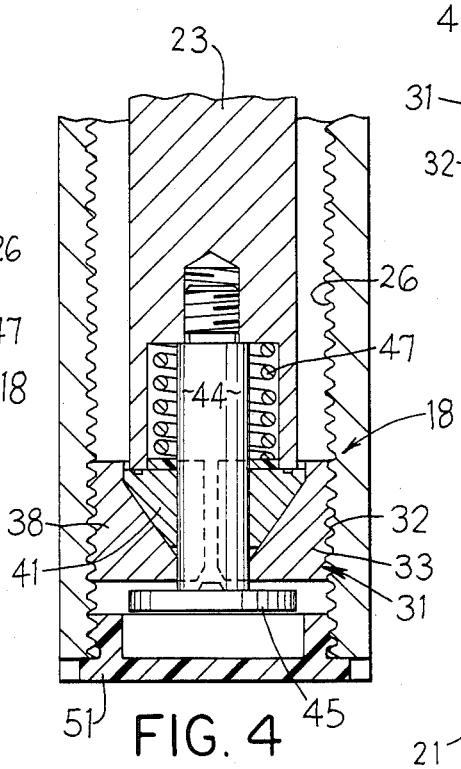
FIG. 4 is a view similar to FIG. 3 but showing the mechanism in a released position wherein the chair seat is occupied.
Figure 5:
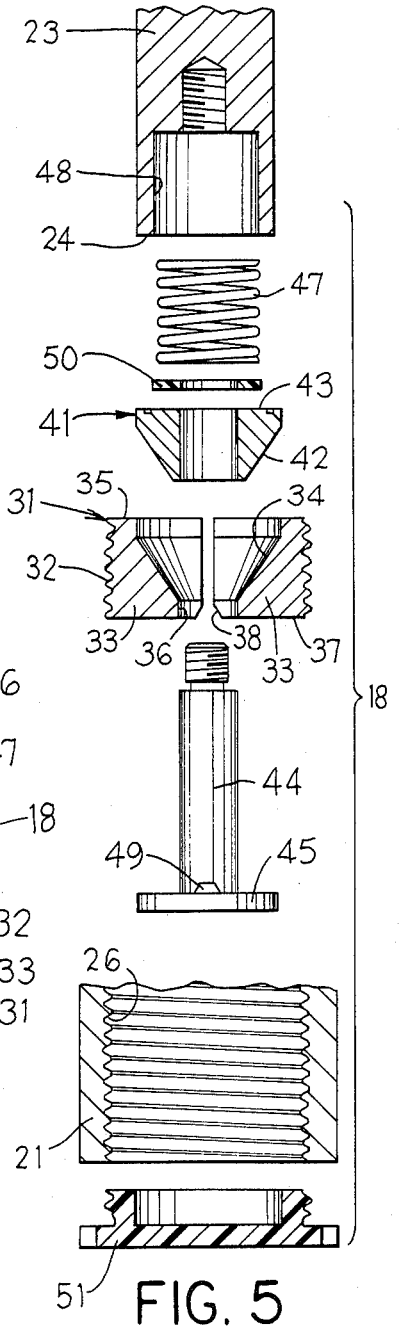
FIG. 5 is a view similar to FIGS. 3 and 4 except that the parts of the mechanism are illustrated in a vertically exploded condition for purposes of illustration.

The pedestal assembly 15 includes a vertically elongated support tube or hub 21 which is fixed centrally to and projects upwardly from the base 14. This support tube 21 has a substantially cylindrical opening 22 extending therethrough, the longitudinal axis of which defines the swivel axis 16. A vertically elongated and substantially cylindrical spindle 23 is rotatably telescopically supported within the support tube 21, which spindle 23 projects upwardly out of the support tube and is interconnected to the tilt mechanism 17 at a location disposed centrally under the seat 13. Spindle 23, at its lower end, defines thereon an end face 24 (FIG. 3).

A hub liner 25, normally of a plastics material, is stationarily seated within the support tube 21 throughout the upper portion of opening 22 so as to rotatably support the spindle 23. The tube opening 21, over a substantial axial extent projecting upwardly from the lower end thereof, is internally threaded at 26.

The height-adjusting mechanism 18 cooperates between the support tube 21 and the spindle 23. This height-adjusting mechanism 18 is illustrated in detail by FIGS. 2–5.

The mechanism 18 includes a nut 31 which is externally threaded at 32 so as to be threadably engaged with the threaded opening 26. Both the internal and external threads are of the same basic configuration, such as a standard Whitworth thread.

The nut 31 is preferably axially split into several sectors 33, the split preferably being diametral so that there are thus two sectors or halves 33. The nut has an opening or recess 34 which projects downwardly from the top face 35 thereof. This opening 34 projects coaxially downwardly of the nut and has a truncated conical configuration which converges as it projects axially downwardly from the top face 35. This conical opening 34 terminates, at its small diameter end, in a substantially uniform-diameter cylindrical opening 36 which projects coaxially downwardly through the bottom face 37 of the nut. A clutch-receiving groove 38 extends diametrically across the bottom face 37, this groove being formed at the diametral split, such as by forming tapered edges along the opposite sides of the split where the latter intersects the bottom face 37.

The nut 31 is acted on by a wedge 41, the latter being axially confined between but axially movable relative to both the nut 31 and spindle 23. This wedge 41 has an exterior wedging surface 42 which is of a truncated conical configuration having an angle of inclination corresponding to that of the conical opening 34. The wedge 41 is normally of a hard plastic material, and has an upper end face 43 which is disposed opposite and is adapted to abutting engage the lower end face 24 formed on the spindle 23.

The wedge 41 axially slidably surrounds a carrier pin 44 which projects axially downwardly from the spindle 23, which carrier pin 44 has the upper end fixed to the spindle, as by a threaded connection. This carrier pin 44 projects axially downwardly through the wedge and also through the nut and has a clutch plate 45 fixed, here integrally, to the lower end thereof. A biasing means 47, specifically a compression-type coil spring, is disposed within a recess 48 formed in the lower end of the spindle in surrounding relation to the pin 44. The upper end of spring 47 bears against a shoulder formed in the spindle, and the lower end of the spring bears against the upper face 43 of the wedge 41 so as to exert a continuous downwardly-directed biasing force against the wedge. An annular washer 50 is preferably interposed between the spring 47 and the face 43 of the wedge.

The clutch plate 45 has a clutch element 49 formed on the upper face thereof, which clutch element 49 projects axially upwardly and extends substantially diametrically across the clutch plate. This clutch element 49 is formed similar to a pin or rib and has a wedge-shaped cross section as it projects upwardly so as to project into the diametral groove 38 formed in the lower face of the nut 31.

A removable cup-like cap 51 is threadably engaged within the lower end of the threaded opening 26 so as to close off the support tube.

OPERATION

The operation of the height-adjusting mechanism will be briefly described to ensure a complete understanding thereof.

When the chair is occupied, the weight of the occupant causes the seat 13 and the interconnected spindle 23 to be moved downwardly against the opposition of the spring 47 so that the lower end face 24 of the spindle bears against the upper face 43 of the wedge 41. The weight of the occupant forces the wedge 41 downwardly into the conical opening 34 and hence effects outward wedging of the nut sectors 33 away from one another, whereby the external thread 32 on the nut sectors 33 is wedged tightly into engagement with the threaded opening 26 so that the nut sectors are effectively locked up and hence are nonrotatable relative to the support tube 21. At the same time, the clutch element 49 has been moved downwardly out of engagement with the groove 38 in the nut. The occupant can thus readily rotate or swivel the chair seat and the spindle 23 about the axis 16, which swiveling of the spindle 23 occurs within the hub liner 25 with the lower face 24 of the spindle being rotatably supported on the top face 43 of the wedge 41. This swiveling of the chair seat does not affect or cause any change in the vertical height of the chair seat.

When the occupant vacates the chair, spring 47 biases the spindle 23 and the chair seat upwardly, and this causes the carrier pin 44 to move upwardly until the clutch element 49 engages the bottom face 37 of the split nut. Assuming that the clutch element 49 is not aligned with the groove 38, then when the chair seat is swiveled or rotated sufficiently as to cause clutch element 49 to align with groove 38, then the spring 47 biases the spindle further upwardly so as to cause the clutch element 49 to clutchingly engage within the groove 38.

With the chair in the unoccupied position as explained above, and with the clutch engaged, the spring 47 exerts a downward pressure on the wedge 41 which cooperates with the conical opening 34 so that the nut sectors 33 are still maintained with the external threads thereon in threaded engagement with the threaded opening 26. However, the friction created between the cooperating threads is of lesser magnitude than when the chair seat is occupied. With the chair seat unoccupied, the height can then be adjusted by manually applying a rotating force to the chair so as to effect rotation of the chair seat and spindle 23 which, due to the engagement of the clutch, causes a corresponding rotation of the nut 31 within the threaded opening 26. The vertical height of the chair can be adjusted either upwardly or downwardly depending upon the direction of rotation.

While height adjustment occurs due to the application of a manual rotating force to the chair, as explained above, nevertheless the chair has little tendency to free-wheel and cause loss of height when unoccupied. Since the wedge 41 is spring-urged downwardly to resiliently urge the nut sectors 33 outwardly into engagement with the threaded opening 26 even when the chair is unoccupied, this threaded engagement between the nut 31 and the threaded opening 26 creates a sufficient frictional holding force between the nut 31 and the support tube 21 as to prevent any substantial free-wheeling of the spindle 23 within the support tube 21, and hence prevent any unintentional or undesired loss or change in chair height.

If maintenance or servicing of the mechanism is required, this can be readily accomplished by initially threadably removing the bottom cap 51, followed by the threaded removal of the carrier pin 44. This thus disconnects the spindle so that it can be relatively moved upwardly out of the support tube, following which the split nut can also be readily removed if necessary.

The wedge 41 and cooperating conical recess 34 are preferably provided with an angle of inclination, as measured relative to the vertical axis, in the range of about 40° to about 45°.

With the above mechanism, a vertical height adjustment range of substantial magnitude (such as about four inches) can hence be provided, while at the same time, the overall-height of the mechanism is minimized so as to permit its use with a knee-type tilt control.

While the pedestal mechanism is illustrated in FIG. 1 as being associated with a chair employing a knee-tilt control, it will be appreciated that the upper end of the pedestal could also be used in conjunction with a chair employing a conventional tilt mechanism of the type illustrated by U.S. Pat. Nos. 4,099,774 and 4,067,610, such mechanisms typically being referred to as chair controls and being disposed entirely within the interior of the seat assembly.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chair having a seat means, a base having thereon an upwardly projecting support tube defining a central opening which projects vertically downwardly therethrough, a vertically elongated spindle having the upper end portion thereof nonrotatably interconnected to said seat means, said spindle projecting downwardly so that the lower portion thereof is rotatably positioned and confined within said central opening, said spindle being rotatable about its longitudinal axis relative to said support tube, and a load-released height-adjusting mechanism coacting between said spindle and said support tube for (1) rotatably supporting the seat means when occupied for rotation about the axis of the spindle and (2) permitting the height of said seat means when unoccupied to be vertically adjusted responsive to rotation of the unoccupied seat means relative to the base, said height-adjusting means including a nut threadably engaged with the support tube, releasable clutch means for nonrotatably connecting said nut to said spindle when said seat means is unoccupied, and said spindle being normally maintained in an uppermost position wherein said clutch means is engaged when the seat means is unoccupied, the improvement comprising:

said nut being axially split into at least two sectors which are independently movable radially relative to said longitudinal axis, said nut being maintained in continuous threaded engagement with said support tube, wedge means continuously coacting with said nut sectors for wedgingly urging the nut sectors in opposed radial directions which maintain the nut in threaded engagement with the support tube, spring means normally biasing said wedge means axially toward said nut for causing the nut sectors to be continuously urged in radially opposed directions for maintaining the nut in continuous threaded engagement with the support tube, said spindle having an abutment surface thereon which is normally maintained in axially spaced relationship from said wedge means when said spindle is in its uppermost position due to an unoccupied chair seat means, said abutment surface being disposed in abutting engagement with said wedge means when the spindle is moved downwardly due to an occupied chair seat means so that the load on the spindle urges the wedge means downwardly for causing a corresponding opposed radial urging of the nut sectors to effect a tight wedging threaded engagement of the nut sectors to the support tube so as to prevent rotation between the nut sectors and the support tube.

2. A chair according to claim 1, wherein said nut is externally threaded and is threadably engaged with internal threads formed on said support tube, said nut having a frustoconical opening formed coaxially therein, said wedge means being disposed axially below said abutment surface but above said nut and having an exterior frustoconical surface which is wedgingly engaged within the frustoconical opening of the nut.

3. A chair according to claim 2, wherein said spring means comprises a compression spring which coacts between said spindle and said wedge means for normally urging said spindle upwardly and said wedge means downwardly.

4. A chair according to claim 3, wherein said nut is formed solely by two said sectors which individually extend through an angle of about 180°.

5. A chair according to claim 4, wherein said clutch means includes a clutch member axially and nonrotatably fixed to said spindle and disposed axially below said nut, said clutch member having a clutch part nonrotatably engageable within a diametral slot which extends between the nut sectors when the spindle is in its uppermost position.

6. In a chair having a seat means, a base having pedestal means defining an opening which projects vertically thereof, a vertically elongated spindle which has an upper portion thereof nonrotatably interconnected to said seat means, said spindle having a lower portion thereof rotatably and axially slidably supported within the opening of said pedestal means, the spindle being axially movable between a raised position when the chair seat means is unoccupied and a lowered position when the chair seat means is occupied, first means biasing the spindle upwardly for normally maintaining the spindle in the raised position when the chair seat means is unoccupied, said biasing means permitting the spindle to move into the lowered position due to external loading of the chair when the chair seat means is occupied, and a load-released height-adjusting mechanism coacting between said spindle and said pedestal means for permitting free rotation of the seat means when the latter is occupied and the psindle is in said lowered position and for permitting the height of the seat means to be vertically adjusted relative to the pedestal means when the seat means is unoccupied and the spindle is in said raised position, the improvement wherein said height-adjusting mechanism comprising:

annular thread means formed on said pedestal means and extending over a substantial axial extent, a rigid nut disposed within said opening in coaxial alignment with said spindle, said nut having an annular thread thereon disposed in engagement with the annular thread means on said pedestal means, said nut being axially split so as to have two separate sectors which are independently movable radially with respect to the longitudinal axis of the spindle, said nut defining thereon a first substantially frustoconical wedging surface, said spindle having abutment surface means thereon which is downwardly directed and is spaced upwardly from said nut, said spindle being both axially and rotatably movable relative to said nut, wedge means cooperating with said nut and continually imposing radially directed forces against the sectors for continuously maintaining the nut in frictional threaded engagement with the annular thread means for permitting relative rotation between the nut and pedestal mans when the spindle is in the raised position and for frictionally locking the nut to the annular thread means to prevent relative rotation therebetween when the spindle is in said lowered position, said wedge means being positioned axially between said abutment surface means and said nut and defining thereon a second substantially frustoconical wedging surface which is disposed in wedging engagement with siad first frustoconical wedging surface, second means continuously biasing said wedge means toward said nut for continuously maintaining wedging engagement between said first and second frustoconical surfaces, said wedge means being axially spaced and disengaged from said abutment surface means when said spindle is in said raised position, and said wedge means being engaged with the abutment surface means on said spindle when the spindle is in said lowered position for urging the wedge means downwardly under greater force to effect locking of the nut sectors with the annular thread means.

7. A chair according to claim 6, wherein the pedestal means includes a hollow upright support tube defining said opening therein, said annular thread means being formed directly on said support tube in surrounding relationship to a lower portion of said opening, bearing means associated with an upper portion of said opening for rotatably and axially slidably supporting said spindle, said nut being externally threaded and having an opening extending coaxially thereof and bounded by said first frustoconical surface, said wedge means having said second frustoconical surface extending exteriorly thereof so that the wedge means projects into the central opening of the nut to urge the nut sectors radially outwardly into continuous engagement with the annular thread means.

8. A chair according to claim 7, wherein the second biasing means comprises spring means for exerting a continuous biasing force against said wedge means urging same into continuous wedging engagement with said nut.

9. A chair according to claim 7, wherein said first and second biasing means are both defined by spring means which are confined and coact between said spindle and said wedge means for respectively continuously urging said spindle and wedge means in opposite axial directions, said spring means continuously urging said wedge means axially into wedging engagement with said nut.

10. A chair according to claim 7, including a clutch element fixedly connected to said spindle and disposed adjacent the axial side of said nut which is opposite said wedge means, said nut having means associated therewith for nonrotatable clutching engagement with the clutch element when the spindle is in said raised position.

* * * * *

UNITED STATES PATENT AND TRADEMARK OFFICE

CERTIFICATE OF CORRECTION

PATENT NO. : 4 720 071

DATED : January 19, 1988

INVENTOR(S) : Patrick C. Nelson et al

It is certified that error appears in the above-identified patent and that said Letters Patent is hereby corrected as shown below:

Column 8, line 36; replace "psindle" with ---spindle---.

Column 8, line 61; replace "mans" with ---means---.

Signed and Sealed this

Twelfth Day of July, 1988

*Attest:*

DONALD J. QUIGG

*Attesting Officer*

*Commissioner of Patents and Trademarks*